US005636982A

United States Patent [19]

Santschi et al.

[11] Patent Number: 5,636,982

[45] Date of Patent: Jun. 10, 1997

[54] METHOD AND APPARATUS FOR ACOUSTICALLY ENHANCING COOLING OF CLINKER

[75] Inventors: Mark Santschi, Lee's Summit, Mo.; C. Thom Martin, Severna Park, Md.

[73] Assignee: BHA Group, Inc., Kansas City, Mo.

[21] Appl. No.: 475,769

[22] Filed: Jun. 7, 1995

[51] Int. Cl.[6] ..... F27D 15/02

[52] U.S. Cl. ..... 432/77; 432/78; 432/80; 432/83

[58] Field of Search ..... 432/77, 78, 83, 432/80

[56] References Cited

U.S. PATENT DOCUMENTS

| | | | |
|---|---|---|---|
| 3,469,828 | 9/1969 | Lane | 432/77 |
| 3,831,291 | 8/1974 | Kayatz | 432/77 |
| 4,457,081 | 7/1984 | Von Wedel | 432/77 |
| 4,762,489 | 8/1988 | Schmits et al. | 432/77 |
| 5,129,820 | 7/1992 | Kapper et al. | 432/78 |

*Primary Examiner*—Weilun Lo
*Attorney, Agent, or Firm*—Kokjer, Kircher, Bowman & Johnson

[57] ABSTRACT

A method and apparatus for acoustically enhancing cooling of molten liquid. In one embodiment, a cement plant has a mill in which raw materials are mixed and ground into a powder, a kiln in which the powdered raw material undergoes a calcining process and is converted into a molten liquid known as clinker, a cooler for cooling and solidifying the clinker, and a finishing mill for grinding and mixing the clinker with gypsum and/or other raw materials. The clinker cooler has a transport mechanism for transporting clinker from an inlet end to an outlet end and a plurality of fans, located below the transport mechanism, for blowing air up through the transport mechanism and into the bottom surface of the clinker bed. The clinker cooler has one or more horns positioned on the roof of the cooler for emitting acoustic energy into the cooler. A controller controls activation of each horn independently, such that each horn may be operated continuously or intermittently. Emission of acoustic energy into the cooling chamber of the clinker cooler creates turbulence in the air and molten liquid flowing in the cooler, thereby enhancing the cooling process. The increased turbulence and energy within the cooler assists breaking up of the solidified clinker, thereby enhancing contact between the clinker surface and air.

18 Claims, 2 Drawing Sheets

METHOD AND APPARATUS FOR ACOUSTICALLY ENHANCING COOLING OF CLINKER

BACKGROUND OF THE INVENTION

1. Field of the Invention

The present invention is directed to a method and apparatus for acoustically enhancing cooling of molten liquid. More specifically, the present invention is directed to a cooler having one or more horns for emitting acoustic energy into the cooler to thereby enhance cooling of clinker, a product used to make cement, within the cooler.

2. Description of the Related Art

Conventional techniques for producing cement are well known. Raw materials, such as limestone, clay, fly ash, and possibly other materials are mixed and ground together in a mill to produce a powder. Once mixed, the powdered raw material is fed into a kiln where it is subjected to extremely high temperatures. Subjecting the raw material powder in the kiln to extreme heat converts the powder to a molten liquid form, known as clinker.

Specifically, as part of the conversion of powdered material to a molten liquid, the ground raw materials undergo a calcining process to convert the calcium carbonate found in the limestone into another calcium compound, such as a dicalcium silicate, tricalcium silicate or tricalcium aluminate. It is these calcium compounds resulting from the calcining process which is known as clinker. Clinker, after being cooled and processed to an acceptable state, is ground with gypsum to produce cement. Cement, along with rock, sand, and water, are the key ingredients in concrete.

It is important to lock the chemical characteristics of the calcium compounds into the clinker, and it is known that if the clinker is allowed to cool slowly, some of the constituents will be lost. Therefore, it is a principal object in the production of cement to rapidly cool the molten clinker. Quickly cooling the clinker is not only advantageous for preserving the chemical characteristics of the clinker, but also for material handling purposes.

Previous attempts at cooling molten clinker typically involve passing the clinker through an elongate cooling mechanism, known as a clinker cooler. A number of fans are positioned in the cooler for propelling air into the clinker to enhance the cooling of the clinker. As the molten liquid clinker cools, it solidifies, breaks, and cracks into a large number of pieces. Typically, at the output of the clinker cooler, the chunks and pieces of clinker are subjected to a hammering process which crushes the clinker into smaller, manageable pieces of clinker.

The clinker typically is transported through the cooler on grates having apertures therein. The fans are positioned to blow air up through the apertures in the grates. Some attempts have been made to enhance clinker cooling by modifying the transporting grates so that greater quantities of air will pass up through the grates and into the molten clinker. However, modifying existing cement plants with these proposed systems is extremely expensive.

Additionally, a known problem in the cooling of clinker is what is known as a red river condition. Such a condition exists when the clinker cools more rapidly at some areas than others, resulting in a river of molten clinker flowing through or past areas of solidified clinker. The inability to solidify clinker along the river is particularly troublesome because the hot, molten clinker will quickly damage the grates upon which it is being transported in the areas of the river. Additionally, if the river proceeds all the way to the output of the clinker cooler, it is quite likely that the molten clinker will damage downstream equipment in the cement plant process, thereby resulting in production downtime.

Accordingly, a simple, inexpensive, and effective method and device for cooling clinker are needed. The present invention meets these needs and overcomes the drawbacks of the prior art.

SUMMARY OF THE INVENTION

It is an object of the present invention to provide a method and apparatus for enhancing the cooling of clinker.

It is a further object of the present invention to provide a method and apparatus which may be used with existing clinker coolers for enhancing cooling of clinker.

It is an additional object of the present invention to provide a method and apparatus for acoustically enhancing cooling of clinker.

An additional object of the present invention is to provide a clinker cooler having one or more horns positioned to emit acoustic energy into the cooler for enhancing cooling of clinker within the cooler.

It is an additional object of the present invention to provide a cement plant having a clinker cooler with components for acoustically enhancing cooling of the clinker in the cooler.

It is yet another object of the present invention to provide a cooler for molten liquid, the cooler having one or more horns for emitting acoustic energy into the cooler, wherein activation of each horn is independently controllable.

These and other objects are achieved by a clinker cooler having one or more acoustic horns positioned on the cooler. The horns are activated to emit acoustic energy into the cooling chamber, thereby agitating both the air and the clinker within the cooler.

More specifically, the clinker cooler of the present invention is, like conventional clinker coolers, an elongate vessel into which molten clinker is introduced. A transporting mechanism, comprised of a series of grates, assists in transporting the clinker to an outlet end of the cooler. All, or selected ones, of the transporting grates have small apertures therein. Any clinker that perhaps falls through the small apertures in the grates is collected by hoppers and transported by a discharge mechanism to the output area of the clinker cooler. Preferably, as found in conventional clinker coolers, each hopper has associated therewith a high-pressure fan for blowing air into the hopper and up through the apertures in the plates. In this way, the cooling air is blown into contact with the bottom surface of the clinker.

A plurality of horns are positioned on the roof of the clinker cooler. Each horn is positioned to transmit acoustic energy through an aperture in the roof of the cooler. Preferably, there is one horn associated with each fan zone of the cooler. As stated, there is preferably one fan associated with each hopper area of the cooler. A controller is provided for activating the horns as desired, such as continuously or intermittently. Additionally, when multiple horns are utilized, activation of each individual horn may be controlled in any desired manner.

The acoustic vibration caused by the horn or horns of the present invention vibrate the surface of the clinker bed, thereby increasing percolation of the clinker caused by the blowing air. Additionally, the acoustic energy causes both the air and the clinker to become more turbulent, thereby increasing the contact between the two and, thus, enhancing cooling of the clinker. As a result, cooling time is decreased, thereby enhancing the quality of the clinker and resulting cement product and reducing the likelihood of a red river developing in the clinker cooler. An additional benefit is the increased fuel efficiency associated with enhanced clinker cooling.

BRIEF DESCRIPTION OF THE DRAWINGS

The objects and features of the invention noted above are explained in more detail with reference to the drawings, in which like reference numerals denote like elements, and in which.

DETAILED DESCRIPTION OF THE INVENTION

Figure 1:
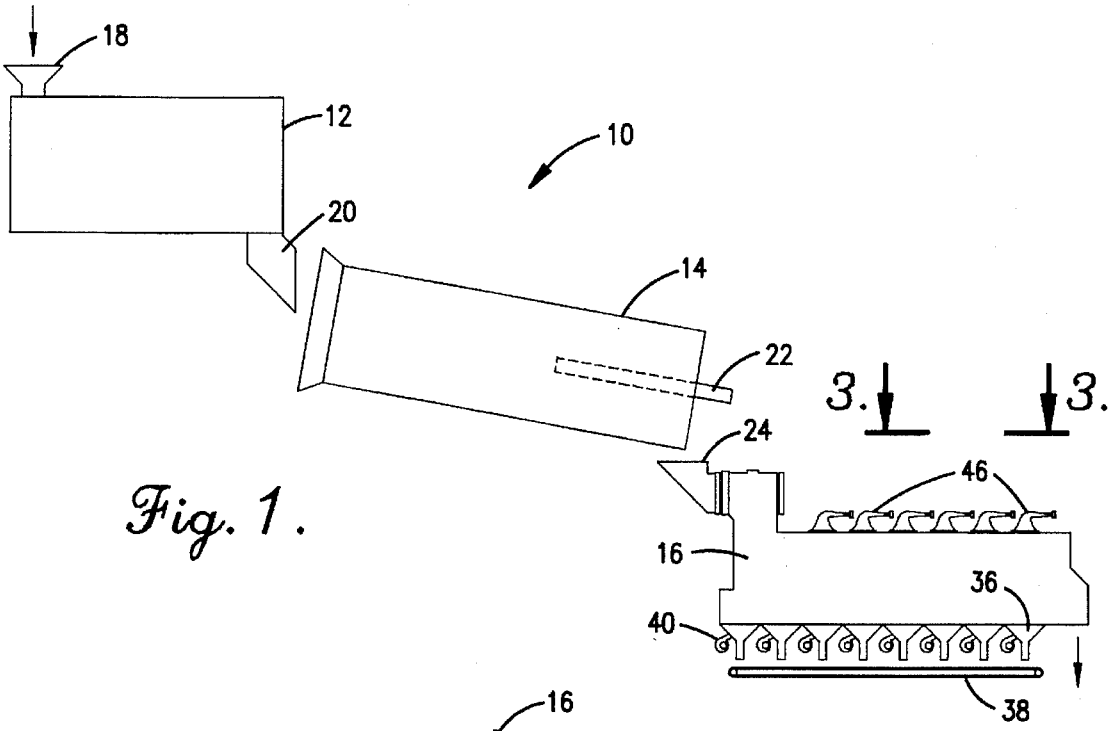
FIG. 1 is a schematic diagram of a kiln process of a cement plant in accordance with the present invention.

With reference initially to FIG. 1, a kiln process, as a portion of a cement plant of the present invention, is denoted generally by reference numeral 10. Kiln process 10 includes a mill 12, a kiln 14, and a cooler 16. That portion of the cement plant and kiln process represented by reference numeral 10 is shown schematically for illustrative purposes. The precise construction of conventional cement plants will be understood by those with skill in this art.

As previously discussed, in the production of cement, raw materials are introduced into inlet 18 of mill 12. Typical raw materials introduced into mill 12 include limestone, clay, fly ash, and possibly other raw materials. In mill 12, raw materials are ground and mixed together into a powder by conventional means, such as grinding balls. The raw material in powder form is discharged from mill 12 through outlet 20. The powdered raw material is introduced into kiln 14 where it is subjected to extremely high temperatures developed by burner 22. It will be appreciated that the actual size, incline, and temperature associated with kiln 14 will vary depending upon the application. Kiln 14 is rotated by a rotating mechanism (not shown). As will be understood, the raw material powder introduced into kiln 14 undergoes a calcining process and, as a result of the extreme heat to which it is subjected, is converted into molten liquid. This molten liquid, known as clinker, is discharged from kiln 14 into inlet 24 of cooler 16. As discussed above, it is a principal object in the production of cement to cool clinker rapidly, and cooler 16 serves this purpose.

Figure 3:
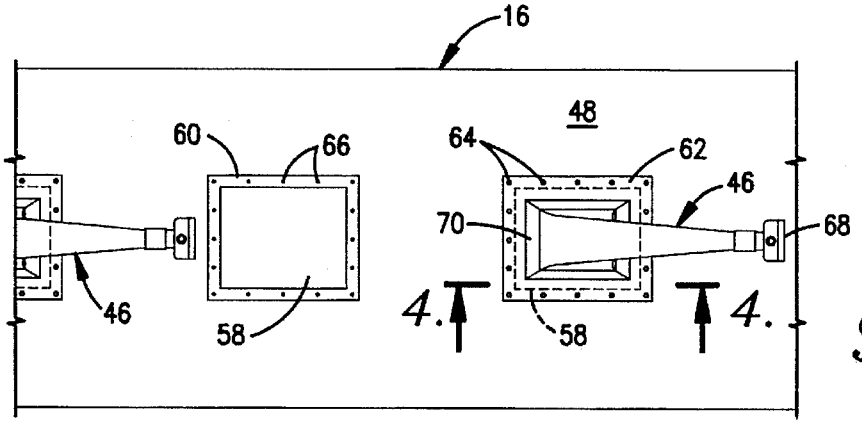
FIG. 3 is a fragmentary top plan view of the clinker cooler of the present invention, with one of the horn assemblies removed.
Figure 4:
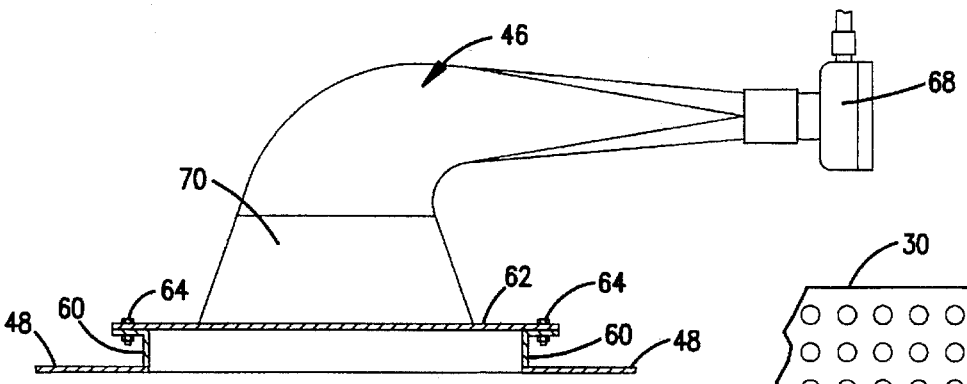
FIG. 4 is a cross-sectional view taken along lines 4—4 of FIG. 3.
Figure 2:
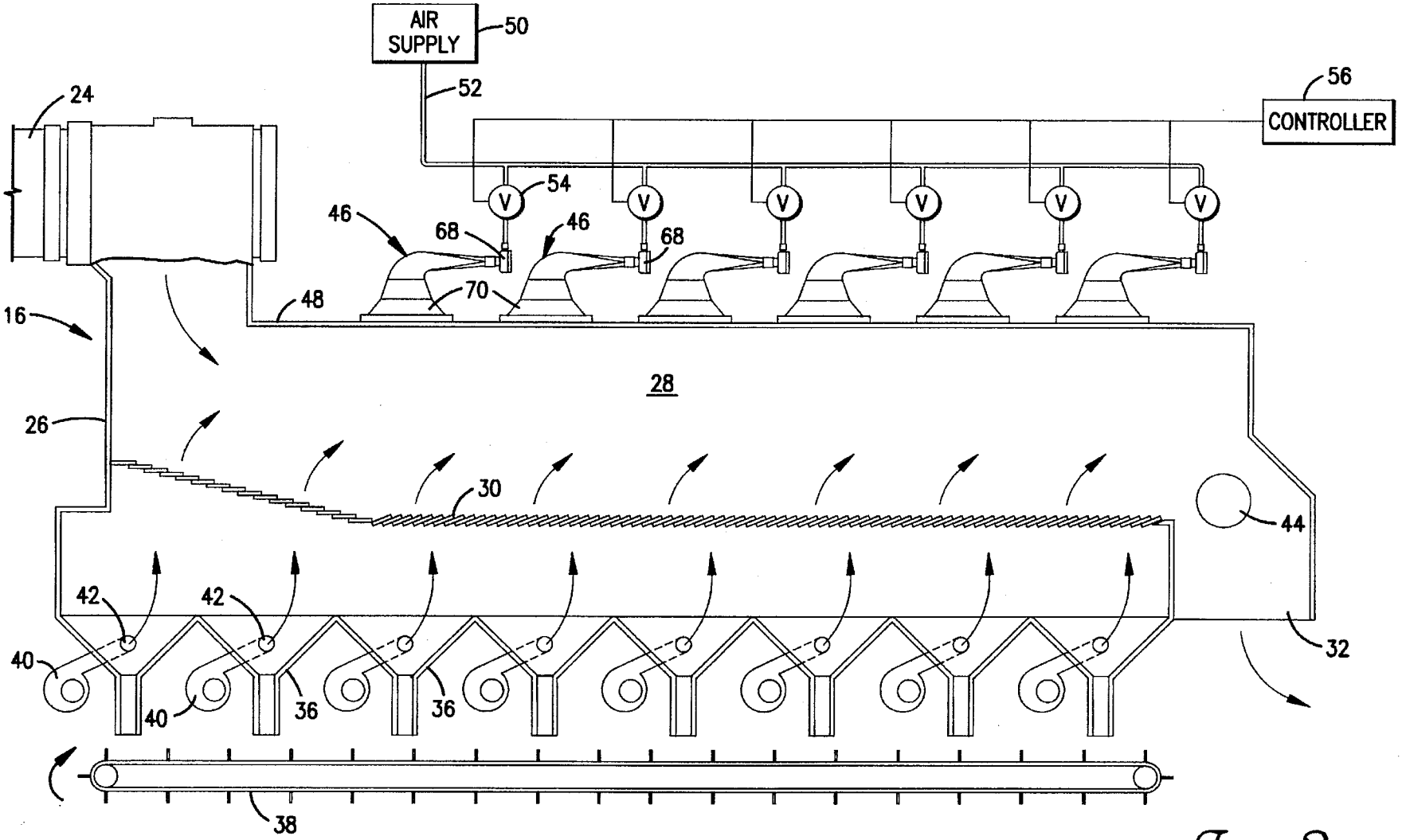
FIG. 2 is a detailed schematic diagram of a clinker cooler of the present invention.

With reference now to FIGS. 2–4, the principal features of the present invention are shown and described.

Figure 5:
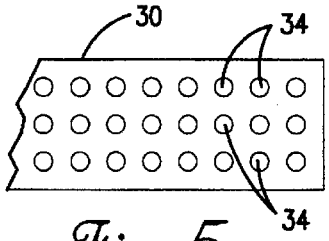
FIG. 5 is a fragmenting top plan view of a conventional grate used in transport mechanisms of clinker coolers.

FIG. 2 shows a detailed schematic diagram of the clinker cooler 16 of the present invention. Clinker cooler 16 has a housing 26 defining an elongate chamber, or receptacle 28. A series of grates 30 provide a transporting mechanism for transporting clinker introduced into inlet 24 of cooler 16 to outlet 32 of cooler 16. As shown in the fragmentary view of FIG. 5, each grate 30 has a plurality of small apertures 34 therein. Preferably, as in conventional coolers, alternate grates 30 are connected to a mechanism (not shown) for imparting back-and-forth motion on the alternate grates, to thereby assist movement of the clinker from inlet end 24 of cooler 16 to outlet end 32 of cooler 16.

Cooler 16 has a series of hoppers 36 positioned at the bottom of the cooler beneath the transporting grates 30. Hoppers 36 receive any clinker which drops beneath grates 30 (e.g., through apertures 34 therein). Clinker received in hoppers 36 drop onto drag chain discharge mechanism 38 which carries the fallen clinker to the output area 32 of cooler 16.

A plurality of high-pressure fans 40 are positioned to blow air into chamber 28 of cooler 16. Preferably, each hopper 36 has a fan 40 associated therewith. As shown in FIG. 2, each hopper 36 has a port 42 therein. Fans 40 blow air through corresponding ports 42 and into chamber 28 in the direction shown by the arrows. As illustrated, the blowing air passes upwardly through apertures 34 in grates 30 to come in contact with the underside surface of the clinker bed being transported on grates 30. The hopper and fan construction described herein will be readily appreciated by those skilled in the art. The air blown by the fans into chamber 28 and upwardly through grates 30 into the flowing bed of clinker causes the clinker to percolate and assists in cooling the clinker. As previously discussed, as the clinker cools, it solidifies and breaks up into various sized chunks, many of which are rather large. A hammer 44, shown schematically, is positioned near the output end 32 of clinker cooler 64 for crushing the clinker into small, manageable pieces prior to discharge from the cooler.

In accordance with the principles of the present invention, a plurality of horns 46 are positioned on the roof 48 of clinker cooler 16. As shown in FIG. 2, each acoustic horn 46 is connected to an air supply 50 by conduit 52 through a corresponding valve 54. A control panel, designated as controller 56, is coupled to each valve 54 for controlling opening and closing of valve 54, and thus controlling activation of the corresponding horns 46.

In the preferred embodiment, a plurality of acoustic horns 46 are located on the roof 48 of cooler 16. However, a single horn 46 may be utilized. Additionally, while it is preferred that the horns 46 are positioned on roof 48 of cooler 16, horns 46 may be positioned at other locations on cooler 16.

With reference now to FIGS. 3 and 4, the preferred manner in which horns 46 are fastened to the roof 48 of cooler 16 is shown and described.

With reference to FIG. 3, and in accordance with the principles of the present invention, a plurality of openings, such as opening 58, are provided in roof 48 of clinker cooler 16. Each acoustic horn 46 is associated with an opening 58. Preferably, each opening 58 is in vertical alignment with a corresponding hopper 36. In this way, acoustic energy transmitted by a horn 48 is emitted through opening 58 into chamber 28 of clinker cooler 16. A flange 60, preferably formed of angle iron, is mechanically attached, such as by a weldment, about the periphery of opening 58. A metallic frame 62 is connected, preferably by a weldment, to the mouth of horn 46. Frame 62 has an unobstructed interior to permit acoustic energy transmitted from the mouth of horn 46 to be unrestricted. Frame 62, having horn 46 attached thereto, is coupled with flange 60 by bolts 64. Specifically, as shown in FIG. 3, flange 60 has a plurality of apertures 66 therein for receiving a plurality of bolts 64.

In operation, acoustic horns 46 are activated, under the control of controller 56, to emit acoustic energy into chamber 28 of cooler 16. It will be understood that, when a valve 54 is in open position, its corresponding horn 46 will emit acoustic energy into chamber 28 of cooler 16. Controller 56 may comprise a control panel for manually and selectively opening and closing valves 54 to thereby selectively activate horns 46. Alternatively, controller 56 may comprise components for automatically controlling valves 54 and, thus, controlling activation of horns 46.

Each horn 46 may be activated continuously or intermittently by controller 56. In one embodiment, controller 56 is operable to activate a selected horn or horns 56 continuously, while remaining horns are activated intermittently. Additionally, since controller 56 controls each valve 54 independently, any desired scheme for activating horns 56 may be employed. In another embodiment, controller 56 comprises timing circuitry for periodically opening and/or closing selected valves 54.

As was previously discussed, introduction of acoustic energy into chamber 28 by horns 46 increases the turbulence of the air in chamber 28, and thus enhances cooling of the clinker. Additionally, it has been found that increased turbulence assists in the breakage of the solidified clinker thereby increasing clinker surface-to-air contact, and further enhancing cooling of the clinker. Since the purpose of the horns 46 is to enhance cooling of the clinker by increased turbulence and energy within chamber 28, the precise manner in which the horns 46 are controlled by controller 46 is dependent upon given circumstances, such as the precise mixture of raw materials used, the thickness of the clinker bed, the pressure of the fans, etc. Enhanced cooling of the clinker resulting from the introduction of acoustic energy into chamber 28 reduces the loss of desired clinker characteristics through vaporization and reduces the likelihood that undesirable red rivers will develop in the clinker.

As will now be readily apparent, the present invention resides in directing acoustic waves into cooling chamber 28 of a cooler 16 for cooling molten liquid. Specifically, one or more horns 46, or other means for generating acoustic energy, is used for directing acoustics to cooling chamber 28. In the preferred embodiment of the present invention, each horn 46 is located on the top of cooling chamber 28 in relation to an aperture cut into the roof 48 of cooler 16. Each horn 34 is preferably one of a type AH series as manufactured by BHA Group, Inc. of Kansas City, Mo., the present assignee. Such horns have a diaphragm (located in diaphragm chamber 68) which vibrates in response to air pressure supplied thereto. The vibrating diaphragm generates acoustic waves which are transmitted through bell portion 70 of the horn 34 and out the mouth of horn 34. Although it is to be understood that the present invention contemplates the use of any frequency of acoustical energy, each horn preferably utilized with the present invention is capable of generating a low-frequency output in the range of 100–500 cycles per second (Hz) while maintaining a minimum of 128 decibels (dB) at the fundamental frequency generated. In operation, as acoustic waves are introduced into cooling chamber 28, the air and molten liquid are excited causing turbulence within chamber 28, thereby enhancing cooling and solidification of the molten liquid.

From the foregoing it will be seen that this invention is one well adapted to attain all ends and objects hereinabove set forth together with the other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative, and not in a limiting sense.

What is claimed is:

1. An apparatus for cooling clinker comprising: a chamber having an inlet for receiving clinker into said chamber and an outlet for discharging clinker from said chamber;

at least one fan for blowing air into said chamber to cool said clinker; and at least one horn for emitting acoustic energy into said chamber to enhance cooling of said clinker.

2. The apparatus as set forth in claim 1 further comprising a transport mechanism for transporting said clinker from said inlet to said outlet.

3. The apparatus as set forth in claim 1 further comprising a controller, coupled with said horn, for controlling activation of said horn.

4. The apparatus as set forth in claim 3 wherein said controller activates said horn continuously.

5. The apparatus as set forth in claim 3 wherein said controller activates said horn intermittently.

6. The apparatus as set forth in claim 3 wherein said controller activates said horn periodically.

7. The apparatus as set forth in claim 1 further comprising a plurality of horns for emitting acoustic energy into said chamber to enhance cooling of said clinker.

8. The apparatus as set forth in claim 7 further comprising a controller, coupled with said horns, for controlling activation of said horns.

9. The apparatus as set forth in claim 8 wherein said controller activates said horns continuously.

10. The apparatus as set forth in claim 8 wherein said controller activates said horns intermittently.

11. The apparatus as set forth in claim 10 wherein at least two horns are intermittently activated differently from each other.

12. The apparatus as set forth in claim 8 wherein said controller activates at least one horn continuously and at least one horn intermittently.

13. The apparatus as set forth in claim 1 wherein said chamber has a roof and said horn is positioned on said roof.

14. The apparatus as set forth in claim 1 wherein said chamber has a roof with a plurality of apertures therein, and said cooler further comprises a plurality of horns such that each horn corresponds with one of said apertures in said roof.

15. The apparatus as set forth in claim 14 further comprising:

a transport mechanism for transporting said clinker from said inlet to said outlet;

a plurality of hoppers located below said transport mechanism; and a plurality of fans, located below said transport mechanism, for blowing air into said clinker, wherein each said fan blows air into one of said hoppers and wherein each said horn is aligned over one of said hoppers.

16. A cement plant comprising:

a mill for mixing raw materials;

a kiln, adapted to receive raw materials mixed in said mill, for heating and treating said mixed raw materials to convert it into clinker; and a cooler, adapted to receive said clinker from said kiln, for cooling said clinker, said cooler having means for transmitting acoustic energy into said cooler to enhance cooling of said clinker therein, whereby said cooled clinker is used in the production of cement.

17. The cement plant as set forth in claim 16 further comprising a finishing mill, adapted to receive said cooled clinker from said cooler, for mixing said cooled clinker with at least one additional raw material, to thereby produce cement.

18. The cement plant as set forth in claim 16 wherein said cooler has a roof with a plurality of apertures therein, and wherein said means for transmitting acoustic energy comprises a plurality of horns such that a horn is associated with each said aperture in said roof of said cooler.

* * * * *